US009147337B2

(12) United States Patent
Cohn et al.

(10) Patent No.: US 9,147,337 B2
(45) Date of Patent: Sep. 29, 2015

(54) METHOD AND SYSTEM FOR LOGGING SECURITY EVENT DATA

(75) Inventors: Alan Wade Cohn, Austin, TX (US); Gary Robert Faulkner, Austin, TX (US); James Edward Kitchen, Austin, TX (US); David Leon Proft, Austin, TX (US); Corey Wayne Quain, Lago Vista, TX (US)

(73) Assignee: iControl Networks, Inc., Redwood City, CA (US)

( * ) Notice: Subject to any disclaimer, the term of this patent is extended or adjusted under 35 U.S.C. 154(b) by 695 days.

(21) Appl. No.: 12/971,282

(22) Filed: Dec. 17, 2010

(65) Prior Publication Data

US 2012/0154138 A1 Jun. 21, 2012

(51) Int. Cl.

*G08B 23/00* (2006.01)
*G08B 25/14* (2006.01)
*G08B 25/00* (2006.01)

(52) U.S. Cl.

CPC ..... *G08B 25/14* (2013.01); *G08B 25/004* (2013.01)

(58) Field of Classification Search

CPC ... H04N 21/6125; H04N 7/181; H04N 7/186; H04M 1/7253; H04M 11/025; G08B 25/10; G08B 25/009; G08B 19/005; G08B 25/004; G08B 25/14

USPC ..... 340/501, 506, 521–523, 532, 539, 340/539.16, 539.17; 726/25; 709/223, 226

See application file for complete search history.

(56) References Cited

U.S. PATENT DOCUMENTS

| | | | | |
|---|---|---|---|---|
| 6,400,265 | B1 * | 6/2002 | Saylor et al. | 340/531 |
| 8,022,833 | B2 * | 9/2011 | Cho | 340/636.1 |
| 8,269,623 | B2 * | 9/2012 | Addy | 340/539.1 |
| 8,675,071 | B1 * | 3/2014 | Slavin et al. | 348/156 |
| 2003/0062997 | A1 | 4/2003 | Naidoo et al. | 340/531 |
| 2003/0071724 | A1 * | 4/2003 | D'Amico | 340/506 |
| 2004/0117462 | A1 | 6/2004 | Bodin et al. | 709/220 |
| 2004/0117465 | A1 | 6/2004 | Bodin et al. | 709/222 |
| 2004/0260407 | A1 * | 12/2004 | Wimsatt | 700/19 |
| 2005/0216580 | A1 | 9/2005 | Raji et al. | 709/223 |
| 2005/0276389 | A1 | 12/2005 | Hinkson et al. | 379/37 |
| 2006/0051122 | A1 | 3/2006 | Kawazu et al. | 399/88 |
| 2006/0067484 | A1 | 3/2006 | Elliot et al. | 379/37 |
| 2006/0078344 | A1 | 4/2006 | Kawazu et al. | 399/69 |
| 2009/0066789 | A1 | 3/2009 | Baum et al. | 348/143 |
| 2009/0070436 | A1 | 3/2009 | Dawes et al. | 709/219 |
| 2009/0070477 | A1 | 3/2009 | Baum et al. | 709/231 |

(Continued)

FOREIGN PATENT DOCUMENTS

| | | |
|---|---|---|
| FR | 2 584 217 | 1/1987 |
| WO | WO 99/34339 | 7/1999 |

(Continued)

OTHER PUBLICATIONS

"Control Panel Standard—Features for False Alarm Reduction," The Security Industry Association, © SIA 2009, pp. 1-48.

*Primary Examiner* — Kerri McNally
(74) *Attorney, Agent, or Firm* — IPR Law Group, PC

(57) ABSTRACT

Through the use of a persistent connection between security, monitoring and automation controller devices and provider supported servers in an operator domain, recordation of sensor fault events, SMA controller events, and communication events is provided. Servers in the operator domain can record events and provide a filtered log of events surrounding an alarm event or other selected timeframe.

34 Claims, 9 Drawing Sheets

(56) References Cited

U.S. PATENT DOCUMENTS

| | | | | |
|---|---|---|---|---|
| 2009/0070681 | A1 | 3/2009 | Dawes et al. | 715/736 |
| 2009/0070682 | A1 | 3/2009 | Dawes et al. | 715/736 |
| 2009/0070692 | A1 | 3/2009 | Dawes et al. | 715/764 |
| 2009/0074184 | A1 | 3/2009 | Baum et al. | 380/205 |
| 2009/0077167 | A1 | 3/2009 | Baum et al. | 709/203 |
| 2009/0077622 | A1 | 3/2009 | Baum et al. | 726/1 |
| 2009/0077623 | A1 | 3/2009 | Baum et al. | 726/1 |
| 2009/0077624 | A1 | 3/2009 | Baum et al. | 726/1 |
| 2009/0134998 | A1 | 5/2009 | Baum et al. | 340/539.1 |
| 2009/0138600 | A1 | 5/2009 | Baum et al. | 709/226 |
| 2009/0138958 | A1* | 5/2009 | Baum et al. | 726/12 |
| 2009/0165114 | A1 | 6/2009 | Baum et al. | 726/12 |
| 2010/0026487 | A1* | 2/2010 | Hershkovitz | 340/541 |
| 2010/0280637 | A1* | 11/2010 | Cohn et al. | 700/90 |
| 2011/0040415 | A1* | 2/2011 | Nickerson et al. | 700/284 |
| 2011/0040877 | A1* | 2/2011 | Foisy | 709/226 |

FOREIGN PATENT DOCUMENTS

| | | |
|---|---|---|
| WO | WO 2004/098127 | 11/2004 |
| WO | WO 2005/091218 | 9/2005 |
| WO | WO 2009/006670 | 1/2009 |

* cited by examiner

METHOD AND SYSTEM FOR LOGGING SECURITY EVENT DATA

FIELD OF THE INVENTION

Embodiments of the present invention relate generally to the field of home security monitoring, and specifically to recording events associated with a remote security, monitoring and automation controller, including zone faults, arm state change, and communication-related events.

BACKGROUND OF THE INVENTION

Residential electronics and control standards provide an opportunity for a variety of options for securing, monitoring, and automating residences. Wireless protocols for transmission of security information permit placement of a multitude of security sensors throughout a residence without a need for running wires back to a central control panel. Inexpensive wireless cameras also allow for placement of cameras throughout a residence to enable easy monitoring of the residence. A variety of home automation control protocols have also been developed to allow for centralized remote control of lights, appliances, and environmental apparatuses (e.g., thermostats). Traditionally, each of these security, monitoring and automation protocols require separate programming, control and monitoring stations. To the extent that home automation and monitoring systems have been coupled to home security systems, such coupling has involved including the automation and monitoring systems as slaves to the existing home security system. This limits the flexibility and versatility of the automation and monitoring systems and ties such systems to proprietary architectures.

A security system alerts occupants of a dwelling and emergency authorities of a violation of premises secured by the system. A home monitoring system monitors a status of a home so that a user can be made aware of any monitored state changes. A home automation system automates and remotely controls lifestyle conveniences such as lighting, heating, cooling, and appliances.

Rather than having multiple devices to control each of the security, monitoring and automation environments, it is desirable to have a centralized controller capable of operating in each environment, thereby reducing the equipment needed in a dwelling. It is further desirable for such a controller to function as a gateway for external network access. Gateway access can include user access to the controller in order to control or monitor devices in locations remote from the dwelling.

Traditional security systems communicate alarm event information directly to a central station alarm monitoring system. Non-alarm events registered by the security system are not provided to the central station. Thus, it is difficult, if not impossible, for a security system provider to track sequences of events leading to and following generation of an alarm event. This can be important in diagnosing proper functioning of a security system or in situations where a dispute arises between an end-user of a security system and the provider of the security system related to performance of the security system or the security system provider during an alarm situation. It is therefore desirable to have a system that records events leading to and following an alarm event. It is further desirable to have these recorded events available to not only an end-user but also to the provider of the security system.

SUMMARY OF THE INVENTION

Through the use of a persistent connection between security, monitoring and automation controller devices and provider supported servers in an operator domain, recordation of sensor fault events, SMA controller events, and communication events is provided. Servers in the operator domain can record events and provide a filtered log of events surrounding an alarm event or other selected timeframe.

One embodiment of the present invention provides for an alarm system controller that is configured to receive and interpret an event signal transmitted by a sensor device, generate an alarm system information packet comprising data associated with the event, and transmit the alarm system information packet on a network. This embodiment also provides for a server system that is remote to the alarm system controller, and which is configured to receive the alarm system information packet using a network interface, interpret the data associated with the alarm system information packet, and store the interpreted data in a memory configured to store data associated with alarm system information packets received from a variety of alarm system controllers.

One aspect of the above embodiment provides for the alarm system controller to also generate an alarm system information packet in response to a change of state of the alarm controller, for example, when the alarm system controller is armed or disarmed.

Another aspect of the above embodiment provides for the server system to generate a central station information packet that contains data associated with the alarm system information packet, if the event associated with the alarm system information packet is an alarm event. This central station information packet is then transmitted to a central station alarm monitoring system over a network.

Another aspect of the above embodiment provides for the server memory to store the alarm system information packet data in a database. Database entries can include an identifier of the originating alarm system controller, an identifier of the event, and a time stamp. A further aspect provides for the server generating a report that includes one or more events associated with an alarm system controller identifier from data recorded in the database. Another further aspect provides for the server generating a report by searching for records associated with an account identifier, and filtering those records to include those records including an alarm event identifier and events having a time stamp within a predetermined range of a time stamp associated with the alarm event.

Another aspect of the above embodiment provides for sensing a loss of communication between the server and the alarm system controller, and storing data in the memory associated with the loss of communication. A further aspect provides for sensing a restoration of communication between the server and the alarm system controller, and storing data in the memory associated with the restoration of communication.

The foregoing is a summary and thus contains, by necessity, simplifications, generalizations and omissions of detail. Consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

The present invention may be better understood, and its numerous objects, features and advantages made apparent to those skilled in the art by referencing the accompanying drawings.

DETAILED DESCRIPTION

Embodiments of the present invention provide a server-based environment for reporting a status of a security, monitoring and automation (SMA) controller and associated sensor and monitoring devices. Embodiments of the present invention provide for an always-on persistent network connection between the SMA controller and a remote server. Through this persistent connection, the SMA controller can report information related to sensor and system events to a server. An aspect of these embodiments further provides for reporting the cessation of the network connection to the servers. These events, and others, are recorded using embodiments of the present invention and made available to selected users of the server systems for analysis.

Architectural Overview

Embodiments of the configurable security, monitoring and automation (SMA) controller of the present invention provide not only for communicating with and interpreting signals from sensors and devices within a dwelling, but also for accessing and monitoring those sensors and devices from locations remote to the dwelling. Embodiments of the SMA controller provide such capability through linkages to external servers via access networks such as the Internet, provider network, or a cellular network. The external servers provide a portal environment through which a user can, for example, monitor the state of sensors coupled to the SMA controller in real-time, configure the controller, and provide controlling information to the SMA controller. The external servers can also monitor the state of the SMA controller and the network connections between the SMA controller and the servers. The servers further provide a connection to a traditional security central station, which can then contact authorities in the event of an alarm condition being detected by the SMA controller in the dwelling.

Figure 1A:
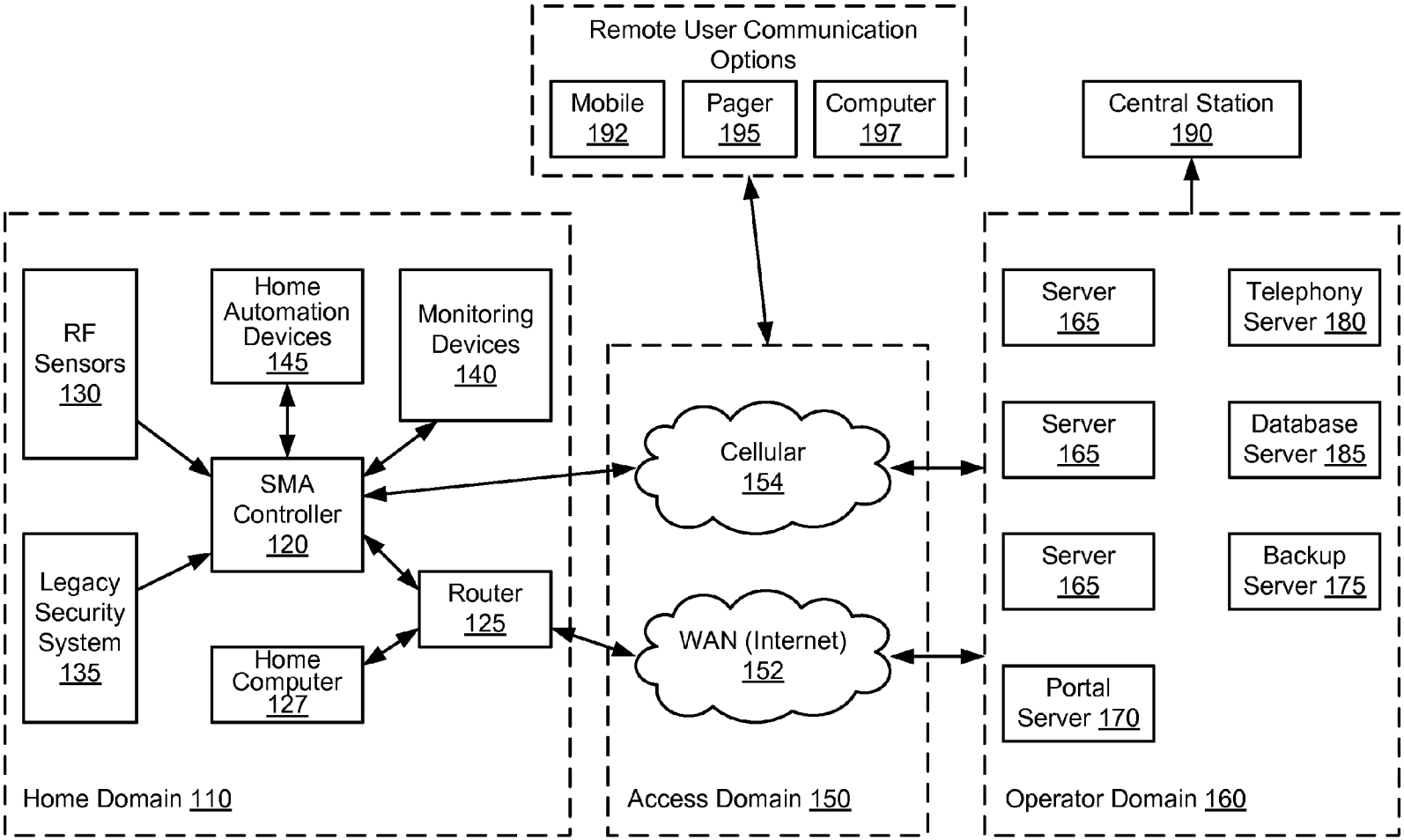
FIG. 1A is a simplified block diagram illustrating an architecture including a set of logical domains and functional entities within which embodiments of the present invention interact.

FIG. 1A is a simplified block diagram illustrating an architecture including a set of logical domains and functional entities within which embodiments of the present invention interact. A home domain 110 includes an embodiment of the SMA controller 120. The home domain is coupled via an access domain 150 to an operator domain 160 that includes various servers. The servers are in turn coupled to a central station 190 and to various remote user communication options.

The home domain refers to a collection of security, monitoring and automation entities within a dwelling or other location having SMA devices. SMA controller 120 is a device that provides an end-user SMA interface to the various SMA entities (e.g., radio-frequency sensors) within home domain 110. SMA controller 120 further acts as a gateway interface between home domain 110 and operator domain 160. SMA gateway 120 provides such gateway access to operator domain 160 via a network router 125. Network router 125 can be coupled to SMA controller 120 and to home network devices such as home computer 127 via either hard wired or wireless connections (e.g., WiFi, tethered Ethernet, and power-line network). A network router 125 coupled to a broadband modem (e.g., a cable modem or DSL modem) serves as one link to networks in access domain 150.

SMA devices within home domain 110 can include a variety of RF or wireless sensors 130 whose signals are received and interpreted by SMA gateway 120. RF sensors 130 can include, for example, door or window sensors, motion detectors, smoke detectors, glass break detectors, inertial detectors, water detectors, carbon dioxide detectors, and key fob devices. SMA gateway 120 can be configured to react to a change in state of any of these detectors. In addition to acting and reacting to changes in state of RF sensors 130, SMA controller 120 also can be coupled to a legacy security system 135. SMA controller 120 controls the legacy security system by interpreting signals from sensors coupled to the legacy security system and reacting in a user-configured manner. SMA gateway 120, for example, will provide alarm or sensor state information from legacy security system 135 to servers in operator domain 160 that may ultimately inform central station 190 to take appropriate action.

SMA gateway 120 can also be coupled to one or more monitoring devices 140. Monitoring devices 140 can include, for example, still and video cameras that provide images that are viewable on a screen of SMA gateway 120 or a remotely connected device. Monitoring devices 140 can be coupled to SMA gateway 120 either wirelessly (e.g., WiFi via router 125) or other connections.

Home automation devices 145 (e.g., home area network devices having an automation interface) can also be coupled to and controlled by SMA gateway 120. SMA gateway 120 can be configured to interact with a variety of home automation protocols, such as, for example, Z-Wave and ZigBee.

Embodiments of SMA controller 120 can be configured to communicate with a variety of RF or wireless sensors and are not limited to the RF sensors, monitoring devices and home automation devices discussed above. A person of ordinary skill in the art will appreciate that embodiments of the present invention are not limited to or by the above-discussed devices and sensors, and can be applied to other areas and devices.

Embodiments of SMA controller 120 can be used to configure and control home security devices (e.g., 130 and 135), monitoring devices 140 and automation devices 145, either directly or by providing a gateway to remote control via servers in operator domain 160. SMA controller 120 communicates with servers residing in operator domain 160 via networks in access domain 150. Broadband communication can be provided by coupling SMA controller 120 with a network router 125, which in turn is coupled to a wide area network 152, such as a provider network or the Internet, via an appropriate broadband modem. The router can be coupled to the wide area network through cable broadband, DSL, and the like. Wide area network 152, in turn, is coupled to servers in operator domain 160 via an appropriate series of routers and firewalls (not shown). SMA controller 120 can include additional mechanisms to provide a communication with the operator domain. For example, SMA controller 120 can be configured with a cellular network transceiver that permits communication with a cellular network 154. In turn, cellular network 154 can provide access via routers and firewalls to servers in operator domain 160. Embodiments of SMA controller 120 are not limited to providing gateway functionality via cellular and dwelling-based routers and modems. For example, SMA gateway 120 can be configured with other network protocol controllers such as WiMAX satellite-based broadband, direct telephone coupling, and the like.

Operator domain 160 refers to a logical collection of SMA servers and other operator systems in an operator's network that provide end-user interfaces, such as portals accessible to subscribers of the SMA service, that can configure, manage and control SMA elements within home domain 110. Servers can also provide management portals for the provider to configure available services to the SMA controllers. Servers in operator domain 160 can be maintained by a provider (operator) of subscriber-based services for SMA operations. Examples of providers include cable providers, telecommunications providers, and the like. A production server architecture in operator domain 160 can support SMA systems in millions of home domains 110.

Individual server architectures can be of a variety of types, and in one embodiment, the server architecture is a tiered Java2 Enterprise Edition (J2EE) service oriented architecture. Such a tiered service oriented architecture can include an interface tier, a service tier, and a data access logic tier. The interface tier can provide entry points from outside the server processes, including, for example, browser web applications, mobile web applications, web services, HTML, XHTML, SOAP, and the like. A service tier can provide a variety of selectable functionality passed along by the operator to the end user, including widget programs. Service tiers can relate to end user subscription levels offered by the operator (e.g., payment tiers corresponding to "gold" level service, "silver" level service and "bronze" level service). Finally the data access logic tier provides access to various sources of data including database servers.

FIG. 1A illustrates an example set of servers that can be provided in operator domain 160. Servers 165 can support all non-alarm and alarm events, heartbeat, and command traffic between the various servers and SMA controllers 120. Servers 165 can also manage end-user electronic mail and SMS notification, as well as integration with provider billing, provisioning, inventory, tech support systems, and the like.

A portal server 170 can provide various user interface applications, including, for example, a subscriber portal, a mobile portal, and a management portal. A subscriber portal is an end-user accessible application that permits an end-user to access a corresponding SMA controller remotely via standard web-based applications. Using such a subscriber portal can provide access to the same SMA functions that an interface directly coupled to the SMA controller would provide, plus additional functions such as alert and contact management, historical data, widget and camera management, account management, and the like. A mobile portal can provide all or part of the access available to an end-user via the subscriber portal. A mobile portal can be limited, however, to capabilities of an accessing mobile device (e.g., touch screen or non-touch screen cellular phones).

A management portal provides an operator representative access to support and manage SMA controllers in home domains 110 and corresponding user accounts via a web-based application. Using a management portal, an operator representative can provision and provide a variety of functionality via, for example, widget programs to the SMA controllers, as will be discussed in greater detail below. The management portal can provide tiers of management support so that levels of access to user information can be restricted based on authorization of a particular employee. User information can include, for example, records of events transmitted by SMA controllers to the operator domain, as will be discussed in greater detail below.

Telephony server 180 can process and send information related to alarm events received from SMA controllers 120 to alarm receivers at central monitoring station 190. A server 165 that processes the alarm event makes a request to telephony server 180 to dial the central station's receiver and send corresponding contact information. Telephony server 180 can communicate with a plurality of central stations 190. Server 165 can determine a correct central station to contact based upon user account settings associated with the transmitting SMA controller. Thus, alarms can be routed to different central stations based upon user accounts. Further, accounts can be transferred from one central station to another by modifying user account information. Telephony server 180 can communicate with alarm receivers at central station 190 using, for example, a security industry standard contact identification protocol (e.g., dual-tone multi-frequency [DTMF]) and broadband protocols.

A backup server 175 can be provided to guarantee that an alarm path is available in an event that one or more servers 165 become unavailable or inaccessible. A backup server 175 can be co-located to the physical location of servers 165 to address scenarios in which one or more of the servers fail. Alternatively, a backup server 175 can be placed in a location remote from servers 165 in order to address situations in which a network failure or a power failure causes one or more of servers 165 to become unavailable. SMA controllers 120 can be configured to transmit alarm events to a backup server 175 if the SMA controller cannot successfully send such events to servers 165.

A database server 185 provides storage of all configuration and user information accessible to other servers within operator domain 160. Database server 185 can also provide storage of event data associated with all SMA controllers coupled to operator domain 160. As will be discussed in greater detail below, such event data can be used to track event sequences occurring around the time of an alarm event. Selection of a type of database provided by database server 185 can be dependent upon a variety of criteria, including, for example, scalability and availability of data. One embodiment of the present invention uses database services provided by an Oracle database.

Figure 1B:
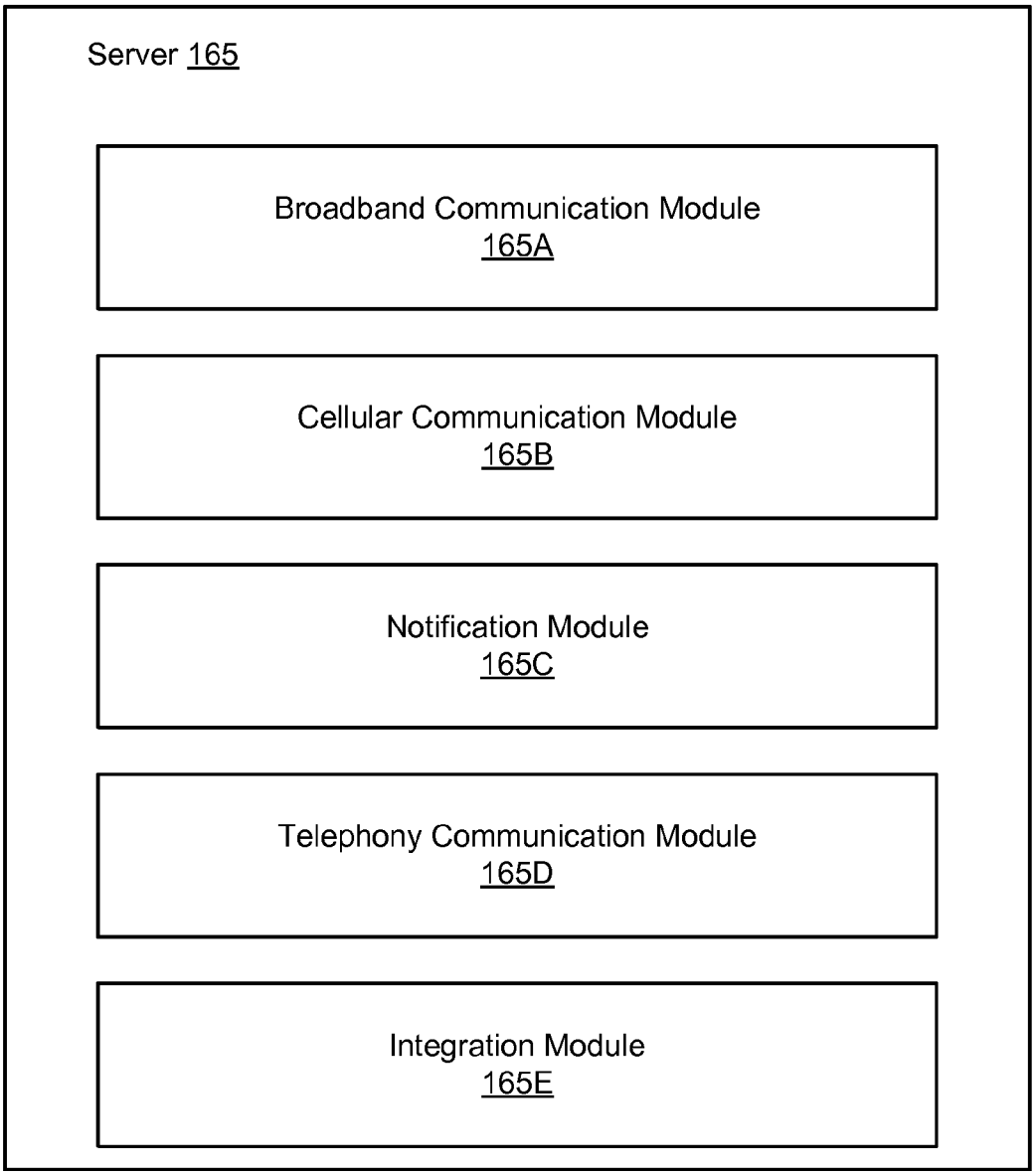
FIG. 1B is a simplified block diagram illustrating a logical architecture for a server usable by embodiments of the present invention.

FIG. 1B is a simplified block diagram illustrating a logical architecture for a server 165 usable by embodiments of the present invention. A server 165 in operator domain 160 provides a variety of functionality. Logically, a server 165 can be divided into the following functional modules: a broadband communication module 165A, a cellular communication module 165B, a notification module 165C, a telephony communication module 165D, and an integration module 165E.

Broadband communication module 165A manages broadband connections and message traffic from a plurality of SMA controllers 110 coupled to server 165. Embodiments of the present invention provide for the broadband channel to be a primary communication channel between an SMA controller 120 and servers 165. The broadband communication module handles a variety of communication, including, for example, all non-alarm and alarm events, broadband heartbeat, and command of traffic between server 165 and SMA controller 120 over the broadband channel. Embodiments of the present invention provide for an always-on persistent TCP socket connection to be maintained between each SMA controller and server 165. A variety of protocols can be used for communications between server 165 and SMA controller 120 (e.g., XML over TCP, and the like). Such communication can be secured using standard transport layer security (TLS) technologies. Through the use of an always-on socket connection, servers 165 can provide near real-time communication between the server and an SMA controller 120. For example, if a user has a subscriber portal active and a zone is tripped within home domain 110, a zone fault will be reflected in near real-time on the subscriber portal user interface.

Cellular communication module 165B manages cellular connections and message traffic from SMA controllers 120 to a server 165. Embodiments of the present invention use the cellular channel as a backup communication channel to the broadband channel. Thus, if a broadband channel becomes unavailable, communication between an SMA controller and a server switches to the cellular channel. At this time, the cellular communication module on the server handles all non-alarm and alarm events, and command traffic from an SMA controller. When a broadband channel is active, heartbeat messages can be sent periodically on the cellular channel in order to monitor the cellular channel. When a cellular protocol communication stack is being used, a TCP socket connection can be established between the SMA controller and server to ensure reliable message delivery for critical messages (e.g., alarm events and commands). Once critical messages have been exchanged, the TCP connection can be shut down thereby reducing cellular communication costs. As with broadband communication, XMPP can be the messaging protocol used for such communications. Similarly, such communication can be secured using TLS and SASL authentication protocols. Non-critical messages between an SMA controller and a server can be sent using UDP. A compressed binary protocol can be used as a messaging protocol for such communications in order to minimize cellular costs for such message traffic. Such messages can be secured using an encryption algorithm, such as the tiny encryption algorithm (TEA). Cellular communication can be established over two network segments: the GSM service provider's network that provides a path between an SMA controller and a cellular access point, and a VPN tunnel between the access point and an operator domain data center.

A notification module 165C determines if and how a user should be notified of events generated by their corresponding SMA controller 120. A user can specify who to notify of particular events or event types and how to notify the user (e.g., telephone call, electronic mail, text message, page, and the like), and this information is stored by a database server 185. When events such as alarm or non-alarm events are received by a server 165, those events can be passed asynchronously to the notification module, which determines if, who and how to send those notifications based upon the user's configuration.

Telephony communication module 165D provides communication between a server 165 and telephony server 180. When a server 165 receives and performs initial processing of alarm events, the telephony communication module forwards those events to a telephony server 180 which in turn communicates with a central station 190, as discussed above. Alternatively, communication between server 165 and central station 190 can be direct or using a webserver via a wide area network (e.g., 152). Such communication would obviate the need for a telephony server and telephony communication module, or could be used in conjunction with telephony communications (i.e., telephony communications as a backup to the broadband communications).

Integration module 165E provides infrastructure and interfaces to integrate a server 165 with operator business systems, such as, for example, billing, provisioning, inventory, tech support, and the like. An integration module can provide a web services interface for upstream integration that operator business systems can call to perform operations like creating and updating accounts and querying information stored in a database served by database server 185. An integration module can also provide an event-driven framework for downstream integration to inform operator business systems of events within the SMA system.

As discussed above, the network connection between an SMA controller 120 and a server 165 is always on and persistent. This allows for constant remote monitoring of the state of the SMA controller, sensors, and devices coupled to the SMA controller. Notification module 165C can be configured to report state changes of the SMA controller and sensors to previously determined entities. Such state change information can also include a current communication mode between the SMA controller and server. For example, if broadband communication becomes unavailable and a switch is made to cellular communication, an end user can be automatically notified of the change. Likewise, if all communication with the SMA controller is lost, then a different notification can be provided. The nature of a notification associated with an event can be configured by an end user or provider through portal server 170 or an input device coupled to SMA controller 120.

Connectivity reporting can also be used to report a loss of communication subsequent to a zone fault event and to define a response to such a scenario. An SMA controller can be configured with an entry delay timer that allows a person entering home domain 110, and thereby triggering a zone fault event, to disarm an armed SMA controller before an alarm signal is sent to a central station 190. An intruder to the home domain might take advantage of the unified nature of the SMA controller and disable the SMA controller prior to expiration of the entry delay (i.e., a so-called "smash-and-grab" scenario), in order to prevent sounding of an alarm. The continuous communication between the SMA controller and an operator domain server results in the sensor state change associated with the zone fault event to be provided to a server 165 in near real time, along with a message indicating that the SMA controller's entry delay timer has been initiated. If the server subsequently detects a loss of communication with the SMA controller before a disarm signal is received, the notification module can be configured to relay an alarm signal to, for example, one or more of the end user, the central station, and a provider administrator. The alarm signal can be defined using available central station protocols (e.g., contact ID) to indicate a "smash and grab" scenario or an indication that is agreed upon between the central station provider and the provider of the operator domain services.

The server can further be configured with a delay window that results in the server waiting to report an alarm associated with the zone fault event. This allows for communication to be restored with the SMA controller and a disarm signal to be received prior to transmission of the alarm report. A configurable server delay window can be defined in accord with security industry best practices. Alternatively, the configurable server delay window can be defined in accord with a provider's specifications (e.g., customer tiers or purchased services). The delay window timer can be started at the same time the message indicating that the SMA controller's entry delay timer has been initiated is received. Alternatively, the server can start the delay window timer at the same time the loss of communication is detected. As a further alternative, the server can independently track the entry delay timer when the message indicating that the SMA controller's entry delay timer has been initiated and then start the delay window time subsequent to the expiration of the entry delay timer. In general, a delay window timer tracked by the server can include an aggregation of the entry delay timer, as configured at the SMA controller, and an additional time configured by the provider (e.g., a "smash and grab" wait time). This general delay window timer can be started at the time the message indicating that the SMA controller's entry delay timer has been initiated is received (or alternatively, upon receipt of the zone fault event message while the system state is armed).

Figure 2:
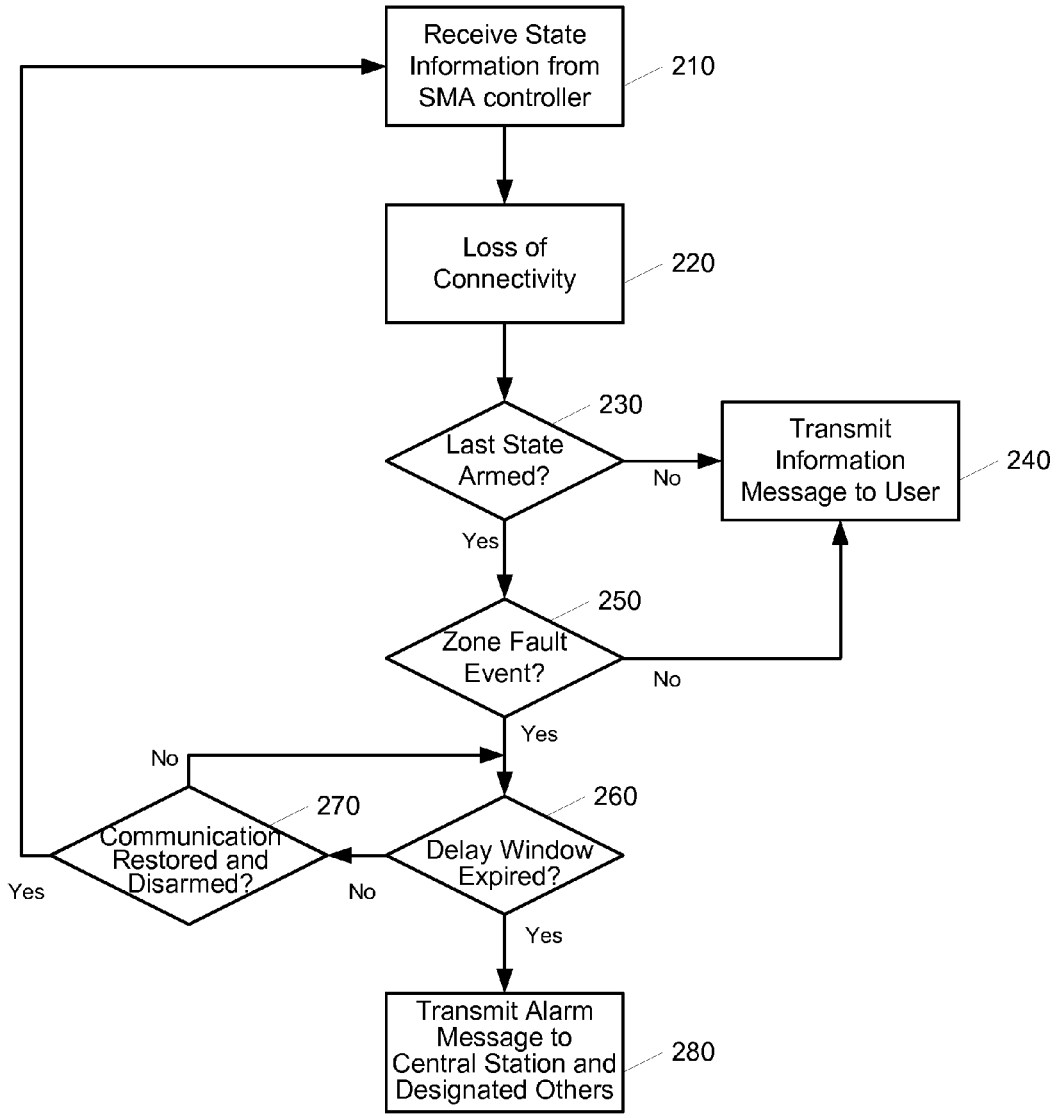
FIG. 2 is a simplified flow diagram illustrating an example of reporting of loss of connectivity and possible transmission of an alarm associated with a zone fault event.

FIG. 2 is a simplified flow diagram illustrating reporting of loss of connectivity and possible transmission of an alarm associated with a zone fault event, in accord with embodiments of the present invention. As discussed above, state information related to the SMA controller is received by a server 165 using, for example, a persistent network connection through a broadband communication module 165A (210). Such state information can include, for example, an indication of continued operation of the SMA controller, arm/disarm, and sensor event state changes (e.g., a zone fault event).

The server then detects a loss of connectivity or communication with the SMA controller (220). If the server determines that the SMA controller was not armed (230), then a notification of the loss of communication is transmitted by notification module 165C to preconfigured recipients (e.g., the end users) (240). If the server determines that the SMA controller was armed at the time of loss of communication (230), a determination can be made as to whether a sensor zone fault event had been detected prior to the loss of communication (250). If no sensor event had been detected, then a notification of loss of communication can be transmitted to the preconfigured recipients (240). If a sensor event had been detected prior to the loss of communication, and the system was armed, then a determination is made as to whether the preconfigured server delay window has expired (260). The delay window is tracked solely by the server, but can include an aggregation of the entry delay configured by the SMA controller as well as an additional time configured by the provider (e.g., the "smash and grab" wait time). The delay window timer can begin at the time a message is received by the server that an entry delay timer has been initiated or at the time the loss of connectivity is detected.

If the delay window has not expired, then a determination is made as to whether communication is restored and the SMA controller is disarmed (270). If communications are restored and the SMA controller is disarmed, then the process can return to a monitoring state (210). If communications are not restored and the SMA controller disarmed, then communications are monitored until the expiration of the delay window. Once the delay window expires without further communication with the SMA controller, an alarm event message is transmitted to a central station 190 and to other preconfigured recipients (280). As discussed above, the alarm event message can be designated as a "smash and grab" alarm event or a general alarm event, as agreed to between the central station provider and the provider of SMA services.

As indicated above, the server-based delay window is configurable by the provider of the SMA services. In one embodiment, the server-based delay window can represent an aggregate of the user-configurable entry delay on the SMA controller and a provider-configurable "smash and grab" delay time (e.g., entry delay of 30 seconds and a "smash and grab" delay time of 60 seconds results in a total delay window of 90 seconds before sending the alarm message to the central station). In another embodiment, an SMA controller can be configured to send an alarm indication message to the remote server, but then the server will wait the delay window time to receive a second alarm message or a cancel message from the SMA controller before sending the alarm message to the central station. In this embodiment, the server can wait for the delay window to expire before sending the alarm if the server hasn't received the second message from the SMA controller. If a second alarm message is received, then an alarm message will be sent to the central station immediately, without waiting for expiration of the delay window. In this scenario, the delay window is the provider-configured "smash and grab" time or an "abort window" per ANSI/SIA CP-01 or the like. In either scenario, the server-based delay time (e.g., the "smash and grab" delay time) can be based upon user tiers (i.e., higher paying customers getting shorter delay times) or other criteria of the provider's choosing.

In addition, FIG. 2 illustrates a determination that a loss of connectivity has occurred. In an alternative embodiment, no such determination need be made. Instead, if SMA controller 120 fails to provide a disarm or some other communication to server 165 within the delay window period, then the alarm message is provided to the central station.

SMA Controller Architecture

Figure 3A:
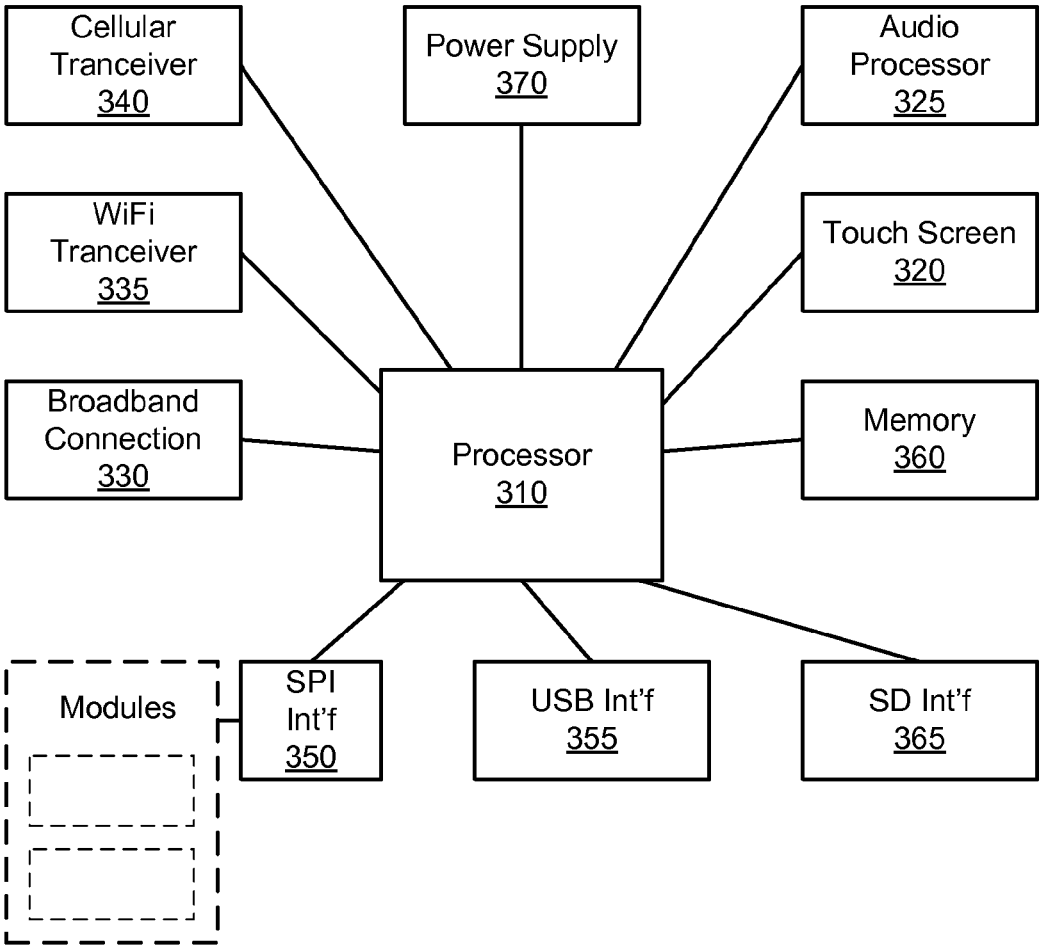
FIG. 3A is a simplified block diagram illustrating a hardware architecture of an SMA controller, usable with embodiments of the present invention.

FIG. 3A is a simplified block diagram illustrating a hardware architecture of an SMA controller, according to one embodiment of the present invention. A processor 310 is coupled to a plurality of communications transceivers, interface modules, memory modules, and user interface modules. Processor 310, executing firmware discussed below, performs various tasks related to interpretation of alarm and non-alarm signals received by SMA controller 120, interpreting reactions to those signals in light of configuration information either received from a server (e.g., server 165) or entered into an interface provided by SMA controller 120 (e.g., a touch screen 320). Embodiments of the present invention can use a variety of processors, for example, an ARM core processor such as a FREESCALE i.MX35 multimedia applications processor.

SMA controller 120 can provide for user input and display via a touch screen 320 coupled to processor 310. Processor 310 can also provide audio feedback to a user via use of an audio processor 325. Audio processor 325 can, in turn, be coupled to a speaker that provides sound in home domain 110. SMA controller 120 can be configured to provide a variety of sounds for different events detected by sensors associated with the SMA controller. Such sounds can be configured by a user so as to distinguish between alarm and non-alarm events.

As discussed above, an SMA controller 120 can communicate with a server 165 using different network access means. Processor 310 can provide broadband access to a router (e.g., router 125) via an Ethernet broadband connection PHY 130 or via a WiFi transceiver 335. The router can then be coupled to or be incorporated within an appropriate broadband modem. Cellular network connectivity can be provided by a cellular transceiver 340 that is coupled to processor 310. SMA controller 120 can be configured with a set of rules that govern when processor 310 will switch between a broadband connection and a cellular connection to operator domain 160.

In order to communicate with the various sensors and devices within home domain 110, processor 310 can be coupled to one or more transceiver modules via, for example, a serial peripheral interface such as a SPI bus 350. Such transceiver modules permit communication with sensors of a variety of protocols in a configurable manner. Embodiments of the present invention can use a transceiver to communicate with a variety of RF sensors 130, using a variety of communication protocols. Similarly, home automation transceivers (e.g., home area network devices having an automation interface) that communicate using, for example, Z-Wave or ZigBee protocols can be coupled to processor 310 via SPI 350. If SMA controller 120 is coupled to a legacy security system 135, then a module permitting coupling to the legacy security system can be coupled to processor 310 via SPI 350. Other protocols can be provided for via such plug-in modules including, for example, digital enhanced cordless telecommunication devices (DECT). In this manner, an SMA controller 120 can be configured to provide for control of a variety of devices and protocols known both today and in the future. In addition, processor 310 can be coupled to other types of devices (e.g., transceivers or computers) via a universal serial bus (USB) interface 355.

In order to locally store configuration information and software (e.g., widget programs) for SMA controller 120, a memory 360 is coupled to processor 310. Additional memory can be coupled to processor 310 via, for example, a secure digital interface 365. A power supply 370 is also coupled to processor 310 and to other devices within SMA controller 120 via, for example, a power management controller module.

SMA controller 120 is configured to be a customer premises equipment device that works in conjunction with server counterparts in operator domain 160 in order to perform functions required for security monitoring and automation. Embodiments of SMA controller 120 provide a touch screen interface (e.g., 320) into all the SMA features. Via the various modules coupled to processor 310, the SMA controller bridges the sensor network, the control network, and security panel network to broadband and cellular networks. SMA controller 120 further uses the protocols discussed above to carry the alarm and activity events to servers in the operator domain for processing. These connections also carry configuration information, provisioning commands, management and reporting information, security authentication, any real-time media such as video or audio, and any data transfer required by locally-executing widget programs.

Figure 3B:
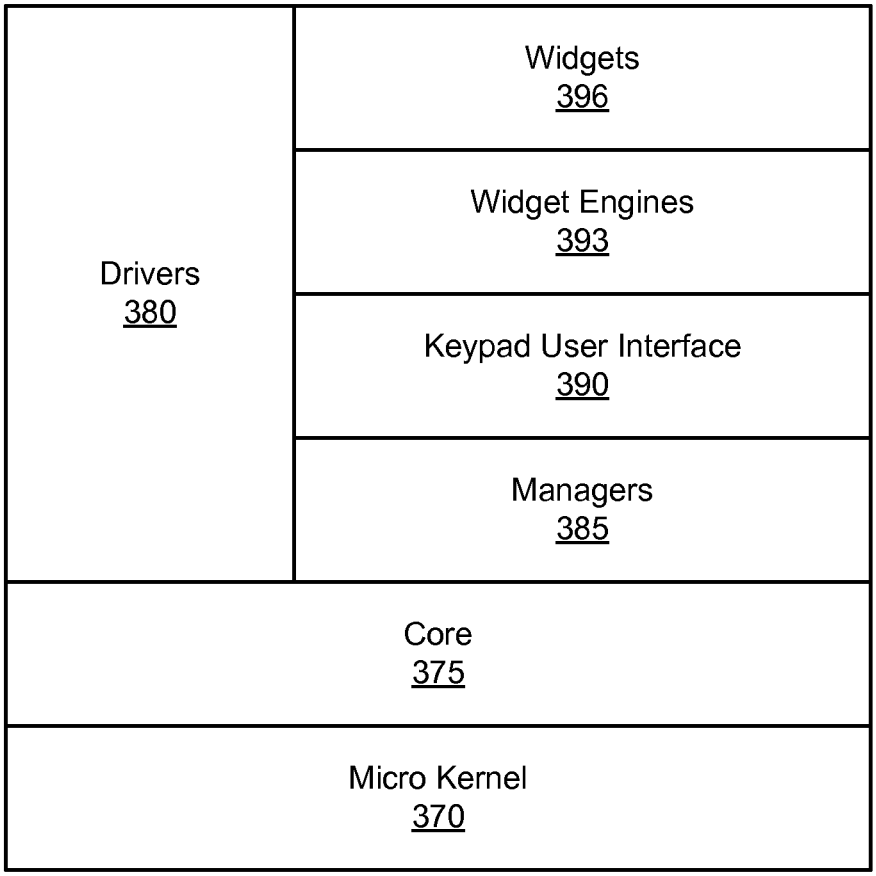
FIG. 3B is a simplified block diagram illustrating a logical stacking of an SMA controller's firmware architecture, usable with embodiments of the present invention.

FIG. 3B is a simplified block diagram illustrating a logical stacking of an SMA controller's firmware architecture, usable with embodiments of the present invention. Since SMA controller 120 provides security functionality for home domain 110, the SMA controller should be a highly available system. High availability suggests that the SMA controller be ready to serve an end-user at all times, both when a user is interacting with the SMA controller through a user interface and when alarms and other non-critical system events occur, regardless of whether a system component has failed. In order to provide such high availability, SMA controller 120 runs a micro-kernel operating system 370. An example of a micro-kernel operating system usable by embodiments of the present invention is a QNX real-time operating system. Under such a micro-kernel operating system, drivers, applications, protocol stacks and file systems run outside the operating system kernel in memory-protected user space. Such a micro-kernel operating system can provide fault resilience through features such as critical process monitoring and adaptive partitioning. As a result, components can fail, including low-level drivers, and automatically restart without affecting other components or the kernel and without requiring a reboot of the system. A critical process monitoring feature can automatically restart failed components because those components function in the user space. An adaptive partitioning feature of the micro kernel operating system provides guarantees of CPU resources for designated components, thereby preventing a component from consuming all CPU resources to the detriment of other system components.

A core layer 375 of the firmware architecture provides service/event library and client API library components. A client API library can register managers and drivers to handle events and to tell other managers or drivers to perform some action. The service/event library maintains lists of listeners for events that each manager or driver detects and distributes according to one of the lists.

Driver layer 380 interacts with hardware peripherals of SMA controller 120. For example, drivers can be provided for touch screen 320, broadband connection 330, WiFi transceiver 335, cellular transceiver 340, USB interface 355, SD interface 365, audio processor 325, and the various modules coupled to processor 310 via SPI interface 350. Manager layer 385 provides business and control logic used by the other layers. Managers can be provided for alarm activities, security protocols, keypad functionality, communications functionality, audio functionality, and the like.

Keypad user interface layer 390 drives the touch screen user interface of SMA controller 120. An example of the touch screen user interface consists of a header and a footer, widget icons and underlying widget user interfaces. Keypad user interface layer 390 drives these user interface elements by providing, for example, management of what the system Arm/Disarm interface button says and battery charge information, widget icon placement in the user face area between the header and footer, and interacting with widget engine layer 393 to display underlying widget user interface when a widget icon is selected.

In embodiments of the present invention, typical SMA controller functions are represented in the touch screen user interface as widgets (or active icons). Widgets provide access to the various security monitoring and automation control functions of SMA controller 120 as well as support for multimedia functionality through widgets that provide, for example, news, sports, weather and digital picture frame functionality. A main user interface screen can provide a set of icons, each of which represents a widget. Selection of a widget icon can then launch the widget. Widget engine layer 393 includes, for example, widget engines for native, HTML and FLASH-based widgets. Widget engines are responsible for displaying particular widgets on the screen. For example, if a widget is developed in HTML, selection of such a widget will cause the HTML widget engine to display the selected widget or touch screen 320. Information related to the various widgets is provided in widget layer 396.

Figure 4:
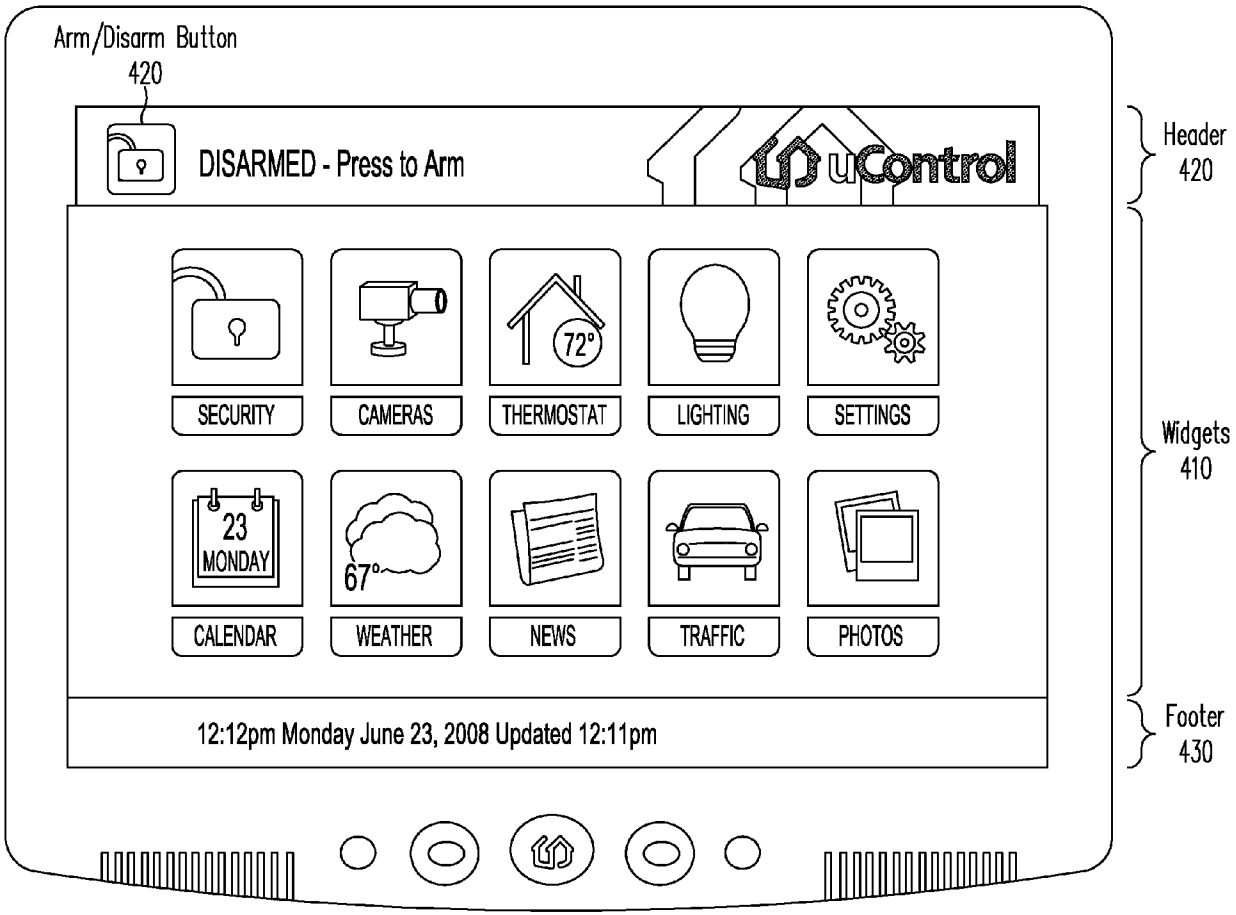
FIG. 4 is an illustration of an example user interface for an SMA controller, usable by embodiments of the present invention.

FIG. 4 is an illustration of an example user interface for an SMA controller 120, according to an embodiment of the present invention. The illustrated user interface provides a set of widget icons 410 that provide access to functionality of SMA controller 120. As illustrated, widgets are provided to access security functionality, camera images, thermostat control, lighting control, and other settings of the SMA controller. Additional widgets are provided to access network-based information such as weather, news, traffic, and digital picture frame functionality. A header 420 provides access to an Arm/Disarm button 425 that allows for arming the security system or disarming it. Additional information can be provided in the header, such as, for example, network status messages. A footer 430 can provide additional status information such as time and date, as displayed.

A user can select widgets corresponding to desired functionality. Embodiments of the present invention provide for access to widgets via portal server 170. A provider of operator domain 160 can determine functionality accessible to users, either for all users or based upon tiers of users (e.g., subscription levels associated with payment levels). A user can then select from the set of accessible widgets and the selected widgets will be distributed and displayed on the user interface of SMA controller 120. Configurability of SMA controller 120 is also driven by user determined actions and reactions to sensor stimulus.

Mechanism for Tracking Event Information

Traditional security systems communicate alarm event information directly to a central station alarm monitoring system. Non-alarm events are not provided to the central station. Nor does the central station provide server-based delay window functionality, as described above. Thus, there is no mechanism for tracking such events.

The operator domain servers, used by embodiments of the present invention, provide a mechanism for tracking all events generated by SMA controllers coupled to the operator domain. As discussed above, through the broadband and cellular communication modules, server 165 maintains persistent communication channels with an SMA controller so as to provide near real-time communication. Through these communication channels, every event (e.g., zone faults, arming/disarming, and the like) registered by an SMA controller is transmitted to a server 165. Further, the servers can detect loss of connectivity between a SMA controller and respond to that loss of connectivity.

As these event messages are received by a server 165, the servers process the event messages and react to the events by providing alerts to users or to a central station alarm monitoring system, if the event is an alarm event. In addition, a server 165 can provide event data to a database server 185 for recording in an event database.

Each record in the event database can include an identifier of the originating SMA controller, an identifier of the type of event, and a time stamp, for example. In addition to this type of event data, SMA controller status can also be recorded in the event database, either as additional information to an event or as a periodic status message. Communication channel status can also be recorded as events in the event database. The database can also include records related to actions taken by the servers in the operator domain in response to the SMA controller messages.

Figure 5:
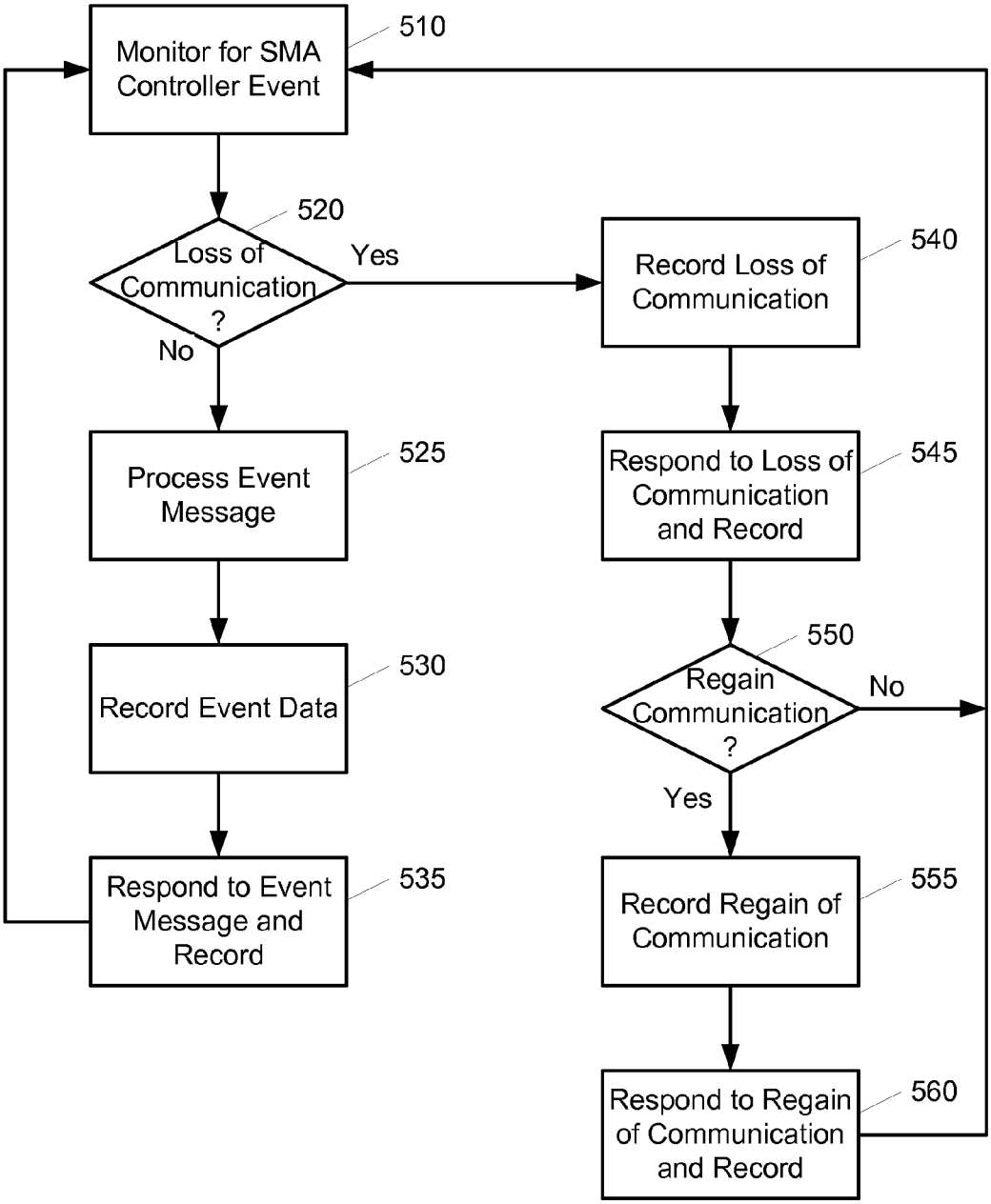
FIG. 5 is a simplified flow diagram illustrating one example of a process performed by an operator domain server to monitor and respond to event message from one or more SMA controllers, according to embodiments of the present invention.

FIG. 5 is a simplified flow diagram illustrating one example of a process performed by an operator domain server (e.g., server 165) to monitor and respond to event message from one or more SMA controllers. A server monitors one of the broadband or cellular networks for events related to an SMA controller supported by the operator domain (510). As discussed above, these events can include zone fault events detected by the sensors coupled to the SMA controller, SMA controller system events such as arming and disarming or power faults, losses in communication with an SMA controller, and the like. If the detected event is not a loss in communication (520), the received event message is processed by the server in the operator domain (525). The event message received from the SMA controller will include an identifier of the SMA controller transmitting the message as well as information related to the nature and source of the event being reported. For example, an event message may include an identifier of a sensor detecting the fault event as well as a time stamp for when the event occurred and other zone information. As the event message is processed, data from the event message can then be recorded in, for example, a database associated with database server 185 (530). Recordation of the event can consist of inclusion of a record in an appropriate table of the database that includes an identifier of the source SMA controller, and other event identifying information. The server can also respond appropriately to the event message and record the nature of and performance of the response in the database (535). For example, if a user of the SMA controller has configured the system to report all occurrences of doors opening and closing to a mobile device, the server can perform that reporting as well as record an entry in the database when the performance of that action has occurred.

If the event is a loss of communication (520), then the server can record an entry in the database reflecting that loss of communication with an identified SMA controller (540). The entry can include not only an identifier of the SMA controller to which communication has been lost, but also information reflecting the communication conduit being utilized when communication was lost, a time stamp of when communication was lost, and the like. Once a loss of communication has been detected, the server can also respond to the loss of communication and record an entry in the database reflecting the nature of that response (545). For example, if the server loses communication with an SMA controller over a broadband connection, a response may be to attempt to regain communication with the SMA controller using a cellular connection (e.g., 154). Another example of a response to loss in communication can be those steps discussed above with regard to a "smash-and-grab" scenario in which a timer is begun and transmission of the alarm event is provided to a central station alarm monitoring system in the event the timer expires. All the steps involved in the "smash-and-grab" scenario can be recorded in the database. If communication is not regained (550), then the system can continue to monitor for additional communication or resumption of communication with the SMA controller (510). If communication is restored (550), then a record can be made reflecting the restoration of communication (555). Any necessary responses to such regaining of communication can also be recorded (560). For example, if resumption of communication and subsequent actions from an SMA controller result in cancellation of timers associated with a "smash-and-grab" alarm event, then those actions can be recorded in the database.

The events stored in an operator domain database, or other data storage system, can be filtered and analyzed as required by the provider. For example, all events recorded for a particular SMA controller (or associated subscriber), can be searched for and included in a report requested either by the subscriber or the provider. Such a report can be made available through a subscriber portal or a management portal. In addition, events can be further filtered based upon event type (e.g., communication failure, zone fault, or fault within a particular zone). As discussed above, another type of report that can be useful is an alarm event report in which all events recorded within a time frame before and after a recorded alarm event for a particular subscriber can be gathered and displayed for review. These events include non-alarm events that may provide insight as to what was occurring within the home domain prior to the trigger of the alarm event and how did the system react in response (e.g., provision of an alarm event to a central station alarm monitoring system within an appropriate delay time). Traditional security systems do not provide this functionality because they do not transmit non-alarm event information to a central station and they do not provide an operator domain functionality for recording all events from a security controller.

An Example Computing and Network Environment

As shown above, the present invention can be implemented using a variety of computer systems and networks. An example of one such computing and network environment is described below with reference to FIGS. 6 and 7.

Figure 6:
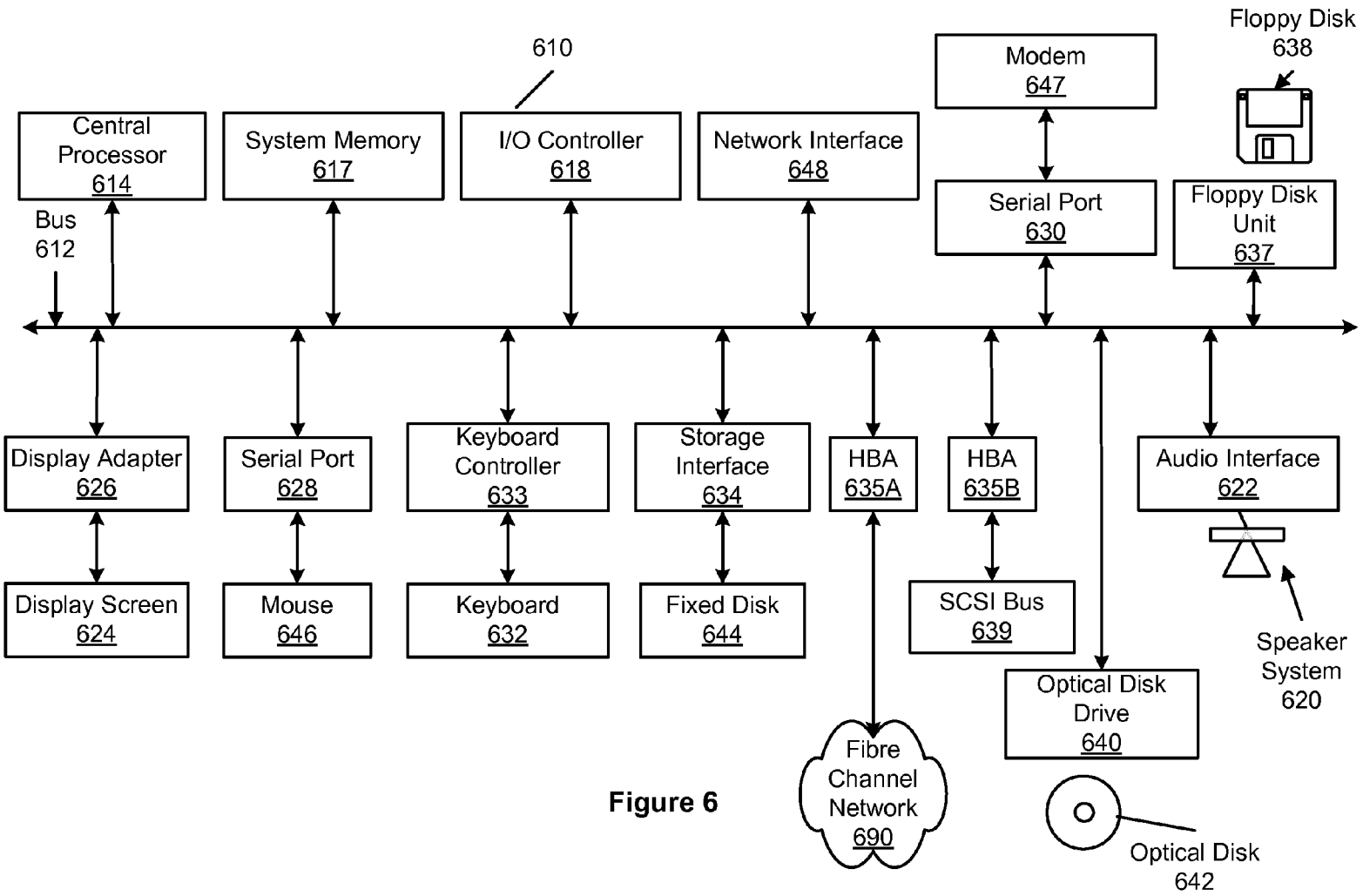
FIG. 6 is a simplified block diagram of a computer system suitable for implementing aspects of the present invention.

FIG. 6 depicts a block diagram of a computer system 610 suitable for implementing aspects of the present invention (e.g., servers 165, portal server 170, backup server 175, telephony server 180, and database server 185). Computer system 610 includes a bus 612 which interconnects major subsystems of computer system 610, such as a central processor 614, a system memory 617 (typically RAM, but which may also include ROM, FLASH RAM, or the like), an input/output controller 618, an external audio device, such as a speaker system 620 via an audio output interface 622, an external device, such as a display screen 624 via display adapter 626, serial ports 628 and 630, a keyboard 632 (interfaced with a keyboard controller 633), a storage interface 634, a floppy disk drive 637 operative to receive a floppy disk 638, a host bus adapter (HBA) interface card 635A operative to connect with a Fibre Channel network 690, a host bus adapter (HBA) interface card 635B operative to connect to a SCSI bus 639, and an optical disk drive 640 operative to receive an optical disk 642. Also included are a mouse 646 (or other point-and-click device, coupled to bus 612 via serial port 628), a modem 647 (coupled to bus 612 via serial port 630), and a network interface 612 allows data communication between central processor 614 and system memory 617, which may include read-only memory (ROM) or FLASH memory (neither shown), and random access memory (RAM) (not shown), as previously noted. The RAM is generally the main memory into which the operating system and application programs are loaded. The ROM or FLASH memory can contain, among other code, the Basic Input-Output system (BIOS) which controls basic hardware operation such as the interaction with peripheral components. Applications resident with computer system 510 are generally stored on and accessed via a computer-readable medium, such as a hard disk drive (e.g., fixed disk 644), an optical drive (e.g., optical drive 640), a floppy disk unit 637, or other storage medium. Additionally, applications can be in the form of electronic signals modulated in accordance with the application and data communication technology when accessed via network modem 647 or interface 648.

Storage interface 634, as with the other storage interfaces of computer system 610, can connect to a standard computer-readable medium for storage and/or retrieval of information, such as a fixed disk drive 644. Fixed disk drive 644 may be a part of computer system 610 or may be separate and accessed through other interface systems. Modem 647 may provide a direct connection to a remote server via a telephone link or to the Internet via an internet service provider (ISP). Network interface 648 may provide a direct connection to a remote server via a direct network link to the Internet via a POP (point of presence). Network interface 648 may provide such connection using wireless techniques, including digital cellular telephone connection, Cellular Digital Packet Data (CDPD) connection, digital satellite data connection or the like.

Many other devices or subsystems (not shown) may be connected in a similar manner (e.g., document scanners, digital cameras and so on). Conversely, all of the devices shown in FIG. 6 need not be present to practice the present invention. The devices and subsystems can be interconnected in different ways from that shown in FIG. 6. The operation of a computer system such as that shown in FIG. 6 is readily known in the art and is not discussed in detail in this application. Code to implement the present invention can be stored in computer-readable storage media such as one or more of system memory 617, fixed disk 644, optical disk 642, or floppy disk 638. The operating system provided on computer system 610 may be MS-DOS®, MS-WINDOWS®, OS/2®, UNIX®, Linux®, or another known operating system.

Moreover, regarding the signals described herein, those skilled in the art will recognize that a signal can be directly transmitted from a first block to a second block, or a signal can be modified (e.g., amplified, attenuated, delayed, latched, buffered, inverted, filtered, or otherwise modified) between the blocks. Although the signals of the above described embodiment are characterized as transmitted from one block to the next, other embodiments of the present invention may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

Figure 7:
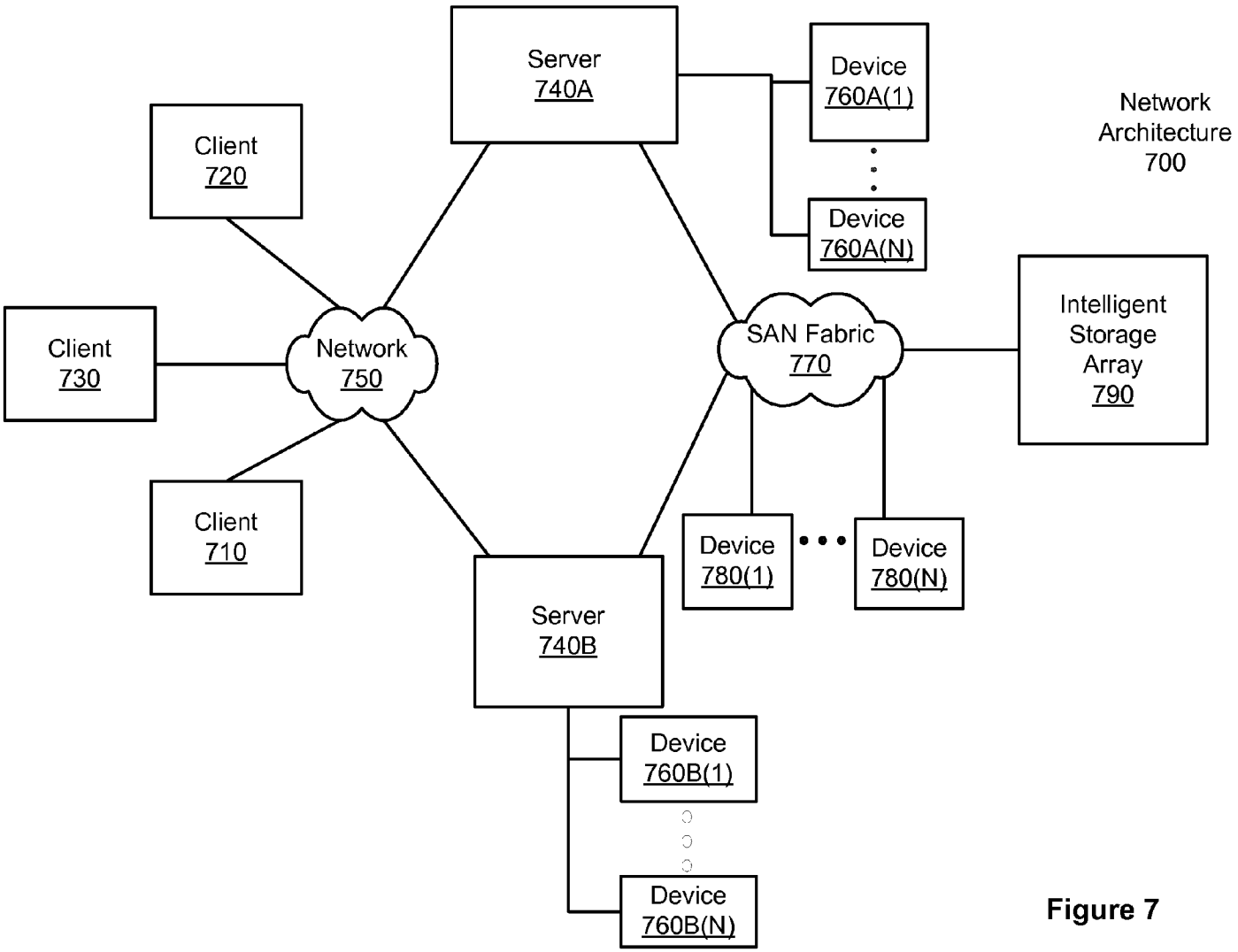
FIG. 7 is a simplified block diagram of a network architecture suitable for implementing aspects of the present invention.

FIG. 7 is a block diagram depicting a network architecture 700 in which client systems 710, 720 and 730, as well as storage servers 740A and 740B (any of which can be implemented using computer system 610), are coupled to a network 750. Storage server 740A is further depicted as having storage devices 760A(1)-(N) directly attached, and storage server 740B is depicted with storage devices 760B(1)-(N) directly attached. Storage servers 740A and 740B are also connected to a SAN fabric 770, although connection to a storage area network is not required for operation of the invention. SAN fabric 770 supports access to storage devices 780(1)-(N) by storage servers 740A and 740B, and so by client systems 710, 720 and 730 via network 750. Intelligent storage array 790 is also shown as an example of a specific storage device accessible via SAN fabric 770.

With reference to computer system 610, modem 647, network interface 648 or some other method can be used to provide connectivity from each of client computer systems 710, 720 and 730 to network 750. Client systems 710, 720 and 730 are able to access information on storage server 740A or 740B using, for example, a web browser or other client software (not shown). Such a client allows client systems 710, 720 and 730 to access data hosted by storage server 740A or 740B or one of storage devices 760A(1)-(N), 760B(1)-(N), 780(1)-(N) or intelligent storage array 690. FIG. 7 depicts the use of a network such as the Internet for exchanging data, but the present invention is not limited to the Internet or any particular network-based environment.

Other Embodiments

The present invention is well adapted to attain the advantages mentioned as well as others inherent therein. While the present invention has been depicted, described, and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The depicted and described embodiments are examples only, and are not exhaustive of the scope of the invention.

The foregoing describes embodiments including components contained within other components (e.g., the various elements shown as components of computer system 610). Such architectures are merely examples, and, in fact, many other architectures can be implemented which achieve the same functionality. In an abstract but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermediate components. Likewise, any two components so associated can also be viewed as being "operably connected," or "operably coupled," to each other to achieve the desired functionality.

The foregoing detailed description has set forth various embodiments of the present invention via the use of block diagrams, flowcharts, and examples. It will be understood by those within the art that each block diagram component, flowchart step, operation and/or component illustrated by the use of examples can be implemented, individually and/or collectively, by a wide range of hardware, software, firmware, or any combination thereof. For example, specific electronic components can be employed in an application specific integrated circuit or similar or related circuitry for implementing the functions associated with one or more of the described functional blocks.

The present invention has been described in the context of fully functional computer systems; however, those skilled in the art will appreciate that the present invention is capable of being distributed as a program product in a variety of forms, and that the present invention applies equally regardless of the particular type of computer-readable media used to actually carry out the distribution. Examples of computer-readable media include computer-readable storage media, as well as media storage and distribution systems developed in the future.

The above-discussed embodiments can be implemented by software modules that perform one or more tasks associated with the embodiments. The software modules discussed herein may include script, batch, or other executable files. The software modules may be stored on a machine-readable or computer-readable storage media such as magnetic floppy disks, hard disks, semiconductor memory (e.g., RAM, ROM, and FLASH-type media), optical discs (e.g., CD-ROMs, CD-Rs, and DVDs), or other types of memory modules. A storage device used for storing firmware or hardware modules in accordance with an embodiment of the invention can also include a semiconductor-based memory, which may be permanently, removably or remotely coupled to a microprocessor/memory system. Thus, the modules can be stored within a computer system memory to configure the computer system to perform the functions of the module. Other new and various types of computer-readable storage media may be used to store the modules discussed herein. A non-transitory computer-readable medium includes all forms of computer-readable media except for a transitory, propagating signal.

The above description is intended to be illustrative of the invention and should not be taken to be limiting. Other embodiments within the scope of the present invention are possible. Those skilled in the art will readily implement the steps necessary to provide the structures and the methods disclosed herein, and will understand that the process parameters and sequence of steps are given by way of example only and can be varied to achieve the desired structure as well as modifications that are within the scope of the invention. Variations and modifications of the embodiments disclosed herein can be made based on the description set forth herein, without departing from the scope of the invention.

Consequently, the invention is intended to be limited only by the scope of the appended claims, giving full cognizance to equivalents in all respects.

What is claimed is:

1. A system comprising:

an alarm system controller comprising, an alarm system processor configured to generate event data of events detected by the processor, wherein the events include alarm events, non-alarm events, communication channel events and alarm system controller entry delay status, and generate an alarm system information packet comprising the event data, and a first network interface, coupled to the processor and a network, and configured to transmit the alarm system information packet on the network; and a remote server system comprising, a second network interface, coupled to the network, and configured to receive the alarm system information packet, a memory, and a server processor, coupled to the second network interface and the memory, configured to interpret the event data of the alarm system information packet, and store the interpreted event data of the alarm system information packet in the memory, wherein the memory is configured to store data associated with each alarm system information packet received from a plurality of alarm system controllers coupled to the network.

2. The system of claim 1, wherein the alarm system processor is configured to generate an alarm system information packet in response to a change of state in the alarm system controller.

3. The system of claim 1, wherein the remote server system comprises:

the server processor configured to generate a central station information packet comprising data associated with the alarm system information packet, if the event associated with the alarm system information packet is classified as an alarm event; and a third network interface, coupled to a second network and the server processor, and configured to transmit the central station information packet on the second network to a central station alarm monitoring system.

4. The system of claim 1, wherein the remote server system comprises the memory configured to store the interpreted data associated with the alarm system information packet in a database, wherein an entry of the database comprises an identifier associated with the alarm system controller, an identifier associated with the event, and a time stamp.

5. The system of claim 4, wherein the server processor is configured to generate a report comprising one or more events associated with an alarm system controller identifier from data recorded in the database.

6. The system of claim 4, wherein the server processor is configured to generate an alarm session report by virtue of being configured to search for records associated with an account identifier from data recorded in the database, and filter the records associated with the account identifier to include records comprising an event identifier associated with an alarm event and events comprising a time stamp within a predetermined range of the alarm event time stamp.

7. The system of claim 1, comprising:

the second network interface configured to sense a loss of communication with the first network interface and a restoration of communication with the first network interface; and the server processor configured to store data in the memory associated with the loss of communication and restoration of communication.

8. The system of claim 1, wherein the events include alarm system controller status.

9. The system of claim 1, wherein the events include alarm system processor status.

10. The system of claim 1, wherein the events include communication channel status of at least one communication channel of the network.

11. The system of claim 1, wherein the events include loss of connectivity between the remote server system and the alarm system controller and regaining connectivity between the remote server system and the alarm system controller.

12. The system of claim 1, wherein the events include at least one action taken by the server processor.

13. The system of claim 1, wherein the events include zone faults.

14. The system of claim 1, wherein the events include arming events and disarming events.

15. The system of claim 1, wherein the detecting of the events by the processor comprises the processor receiving and interpreting an event signal transmitted by a sensor device.

16. A method comprising:

generating event data of events detected by a remote alarm system controller, wherein the events include alarm events, non-alarm events, communication channel events and alarm system controller entry delay status, and generating and transmitting an alarm system information packet comprising the event data;

receiving the alarm system information packet from the remote alarm system controller;

processing the alarm system information packet to interpret the event data of the alarm system information packet; and storing the interpreted event data in a memory, wherein the memory is configured to store alarm system information packet data from a plurality of remote alarm system controllers.

17. The method of claim 16, comprising:

generating a central station information packet comprising data associated with the alarm system information packet, if the event described in the alarm system information packet relates to an alarm event; and transmitting the central station information packet to a central station alarm monitoring system.

18. The method of claim 16, wherein the storing the interpreted data in the memory comprises storing the interpreted data as an entry in a database, wherein the entry comprises an identifier associated with the remote alarm system controller, an identifier associated with the event, and a time stamp.

19. The method of claim 18, comprising generating a report comprising one or more events associated with a remote alarm system controller identifier from data recorded in the database.

20. The method of claim 18, comprising generating an alarm session report, the generating comprising searching for records associated with an account identifier from data recorded in the database, and filtering the records associated with the account identifier to include records comprising an event identifier associated with an alarm event and events comprising a time stamp within a predetermined range of the alarm event time stamp.

21. The method of claim 16, comprising:

sensing a loss of communication with the remote alarm system controller;

storing information in the memory associated with the loss of communication; and storing information in the memory associated with any actions taken related to the loss of communication.

22. The method of claim 21, comprising:

sensing a restoration of communication with the remote alarm system controller; and storing information in the memory associated with the restoration of communication.

23. The method of claim 16, wherein the events include remote alarm system controller status.

24. The method of claim 16, wherein the events include communication channel status of at least one communication channel of the remote alarm system controller.

25. The method of claim 16, wherein the events include loss of connectivity with the remote alarm system controller and regaining connectivity with the remote alarm system controller.

26. The method of claim 16, wherein the events include at least one action taken as a result of the processing.

27. The method of claim 16, wherein the events include zone faults.

28. The method of claim 16, wherein the events include arming events and disarming events.

29. An apparatus comprising:

a network interface, coupled to a network, and configured to receive an alarm system information packet from a remote alarm system controller, wherein the alarm system information packet is generated to include event data of events detected by the remote alarm system controller, wherein the events include alarm events, non-alarm events, communication channel events and alarm system controller entry delay status; and at least one application running on at least one processor, the at least one application, interpreting the event data of the alarm system information packet; and storing the interpreted event data in a memory, wherein the memory is configured to store data associated with each alarm system information packet received from a plurality of alarm system controllers coupled to the network.

30. The apparatus of claim 29, the at least one application:

generating a central station information packet comprising data associated with the alarm system information packet, if the event is classified as an alarm event; and transmitting the central station information packet to a central station alarm monitoring system.

31. The apparatus of claim 29, comprising the memory configured to store the interpreted data associated with the alarm system information packet in a database, wherein an entry of the database comprises an identifier associated with the alarm system controller, the at least one application generating a report comprising one or more events associated with a remote alarm system controller identifier from data recorded in the database.

32. The apparatus of claim 29, comprising the memory configured to store the interpreted data associated with the alarm system information packet in a database, wherein an entry of the database comprises an identifier associated with the alarm system controller, an identifier associated with the event, and a time stamp, the at least one application generating an alarm session report, searching for records associated with an account identifier from data recorded in the database, and filtering the records associated with the account identifier to include records comprising an event identifier associated with an alarm event and events comprising a time stamp within a predetermined range of the alarm event time stamp.

33. The apparatus of claim 29, the at least one application:

sensing a loss of communication with the remote alarm system controller;

storing information in the memory associated with the loss of communication; and storing information in the memory associated with any actions taken related to the loss of communication.

34. The apparatus of claim 33, the at least one application:

sensing a restoration of communication with the remote alarm system controller; and storing information in the memory associated with the restoration of communication.

* * * * *